United States Patent [19]

Luhmer

[11] Patent Number: 4,545,409

[45] Date of Patent: Oct. 8, 1985

[54] ELECTROHYDRAULIC, TWO-STAGE, PROPORTIONAL DISPLACEMENT VALVE

[75] Inventor: Horst Luhmer, Kaarst, Fed. Rep. of Germany

[73] Assignee: Integral Hydraulik & Co., Dusseldorf, Fed. Rep. of Germany

[21] Appl. No.: 600,122

[22] Filed: Apr. 13, 1984

[30] Foreign Application Priority Data

Apr. 13, 1983 [DE] Fed. Rep. of Germany ..... 3313317
Apr. 13, 1983 [DE] Fed. Rep. of Germany ..... 3313318

[51] Int. Cl.[4] ..... F15B 13/043

[52] U.S. Cl. ..... 137/625.64; 137/625.6; 251/30.01

[58] Field of Search ..... 137/625.6, 625.64

[56] References Cited

U.S. PATENT DOCUMENTS

| | | | |
|---|---|---|---|
| 3,709,257 | 1/1973 | Faisandier | 137/625.64 |
| 3,722,547 | 3/1973 | Kirstein | 137/625.63 |
| 3,891,145 | 6/1975 | Batholdmaus et al. | 137/625.6 |
| 4,145,956 | 3/1979 | Rumrill et al. | 137/625.64 X |

*Primary Examiner*—Gerald A. Michalsky
*Attorney, Agent, or Firm*—Holman & Stern

[57] ABSTRACT

An electrohydraulic, two-stage, proportional displacement valve comprising an advance (servo) control stage and a main control stage, the main control stage being in the form of a follower piston in which the advance control stage in the form of a second piston is guided. The second advance control piston is rotatable in the main control piston and has control edges, or control surfaces, which are inclined in the form of a helical thread. The main control piston is axially displaceable but is not freely rotatable, whereas the advance control piston is axially fixed and may be rotated around its axis by a stepping motor. Both the advance control piston and the main control piston are centered in their respective movement domains by springs. In order to adjust the position of the control edges (or surfaces) with respect to the two spring-centering mechanisms, a lever is attached to the follower piston which lever has a radial slot, indentation, or fork which engages a pin eccentrically mounted in the housing.

17 Claims, 2 Drawing Figures

ELECTROHYDRAULIC, TWO-STAGE, PROPORTIONAL DISPLACEMENT VALVE

BACKGROUND OF THE INVENTION

1. Field of the Invention

The invention relates to an electrohydraulic, two-stage, proportional displacement valve having a follower piston system.

2. Description of the Prior Art

It is well known that proportional displacement valves occupy a position midway between ordinary displacement valves and servo valves, with regard to technical value and cost. There are virtually no known proportional displacement valves which employ special servo valve advance control stages, e.g., which may operate with systems comprising a nozzle and deflecting plate. However, advance controls are in common use which operate with two proportional pressure control valves or two proportional pressure limiting valves. The control pressures are varied in proportion to the electrical input signals, and the pressures displace the main control piston with respect to centering springs. There is no positive coupling between the advance control stage and the main control stage. Depending on friction effects and changes in the springs, reproducibility may be low and hysteresis high.

It is also known that in the event of pressure failure in follower piston systems there is a tendency for the system to fall out of adjustment, i.e. to assume an undefined position, unless special hydraulic control systems and/or other centering means for the follower piston are provided. If the drive means of the advance control piston, which drive means may be, e.g., a stepping motor, are also intended to be centered in a prescribed null position, it is desirable for the purposes of facilitating assembly and set-up and lowering manufacturing cost that means be provided for relative adjustment of the null position of the drive and the null position of the control edges, or surfaces, when, as a precondition, the follower piston itself is centered.

BRIEF SUMMARY OF THE INVENTION

It is an object of the invention to provide an electrohydraulic, two-stage, proportional displacement valve of the type comprising a coupling between the advance control and main control stages such that frictional and spring force effects are eliminated. The dependence of the position of the main control piston on the input signals is either direct proportionality or, optionally, an arbitrary mathematical function. The configuration is simple and the system operates in a reliable and maximally wear-free manner.

The advantage of this arrangement lies in the sequentiality of the system, whereby the position of the rotatable advance control piston is determined precisely by means of a prescribed step value of the stepping motor. The main control piston then operates as a follower piston, the position of which no longer depends on friction or on the springs, but only on the accuracy of the control edges.

It is a further object of the invention to enable adjustment by simple means, the adjustment operation being capable of simple accomplishment even by inexperienced personnel. An eccentric adjustment device is provided for this purpose. One may to some advantage choose a relatively large eccentricity, i.e., a gross scale of adjustment for the purpose of adjusting gross manufacturing tolerances. However, this reduces fine sensitivity. It is preferable to fix the null position as accurately as possible at the manufacturing stage and thereafter accomplish fine adjustment by means of a small eccentricity, i.e., a small scale of adjustment. In particular, spring centering of the step motor for the advance control piston should be accomplished on a test stand.

BRIEF DESCRIPTION OF THE DRAWINGS

The invention will now be described in more detail with the aid of an exemplary embodiment and with reference to the drawings wherein.

DETAILED DESCRIPTION

Figure 1:
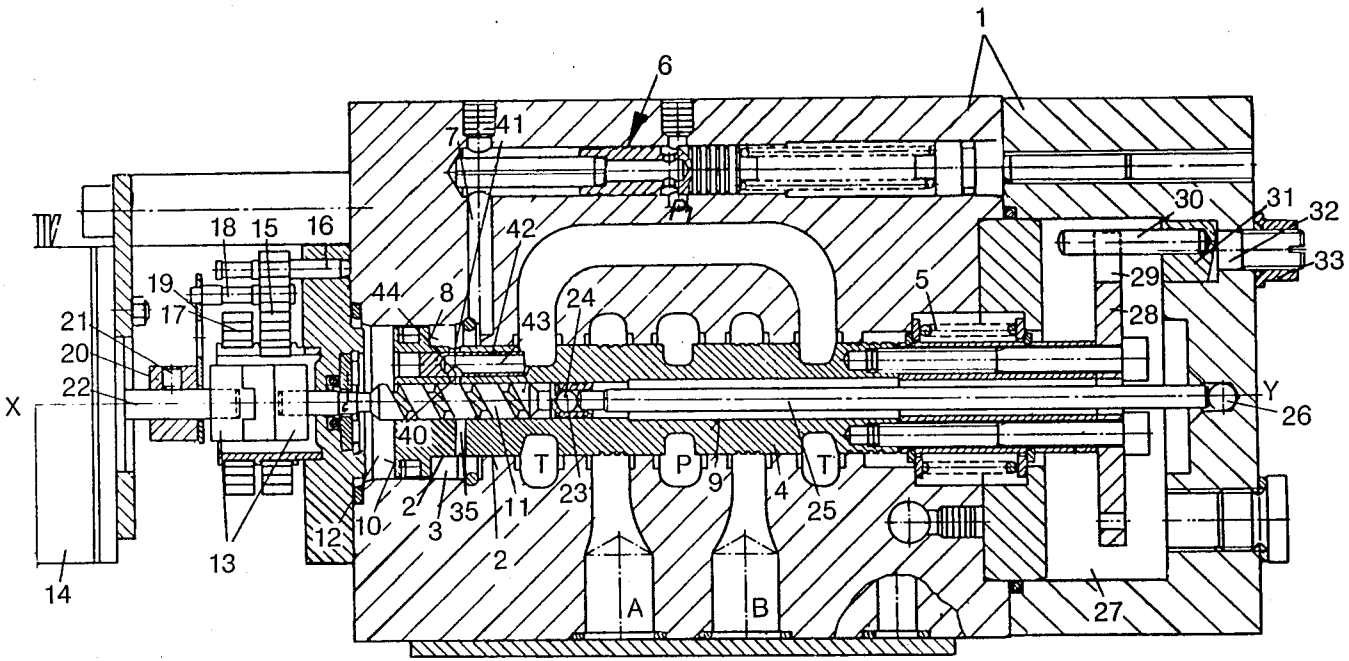
FIG. 1 is a longitudinal cross-sectional view through a proportional displacement valve embodying the invention.
Figure 2:
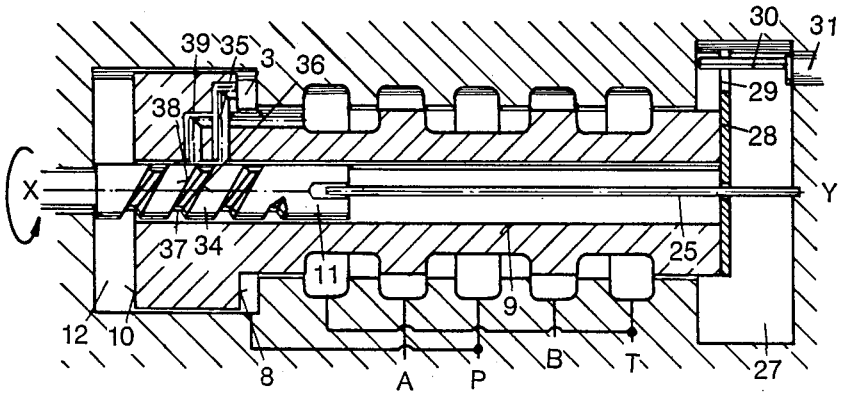
FIG. 2 is a schematic cross-sectional view depicting the interaction of the advance control piston and the main control piston in accordance with the invention.

A stepped bore 2 is provided in a housing 1. A main control piston 4 in the form of a differential stepped piston is disposed in said bore, with the formation of a ring-shaped void 3. The piston is mounted so as to be axially displaceable but not freely rotatable. The main control piston 4 is associated with spring-type centering means 5 which center it in an axially central position, such that a pressure line P is cut off from lines A and B running to consuming devices, and lines A and B in turn are cut off from reservoir line T. Displacement of the piston by different amounts and/or in different directions, yields the following connections: P-A and B-T, or P-B and A-T. The pressure line P communicates with the supply line $P_1$ (not shown) of a pressure regulating valve 6, the low pressure from which serves as a control pressure which is transmitted over a line 7 to the annular space 3 where it continuously acts on an operative surface 8 of the main control piston 4. The main control piston 4 has a bore 9 passing through its entire axial length. An advance (servo) control piston 11, proceeding from an end face 10 which serves as a second operative surface, is guided in said bore, further passes through the control space 12 adjoining the operative surface 10, passes through the housing 1 to the exterior thereof in sealed fashion, and outside the housing is connected to a stepping motor 14 via a coupling 13. The coupling 13 and thus the advance control piston 11 is connected to a spiral spring 15, the opposite end of which is connected to a support member 16 on the housing 1. A second spiral spring 17 is also mounted in similar fashion (not entirely visible in the cross section shown) which spring 17 acts in the opposite direction. A dog 18 is connected via a lever 19 to a boss 20 which can be fixed relative to the drive shaft of the stepping motor 14 by a set screw 21, as a null balance means. The dog 18 releases the spiral spring 15 or the spiral spring 17 from the support member 16, depending on the direction of movement of the stepping motor. When both the spiral springs 15 and 17 are pressing against the support member 16, the dog 18 lies between said springs without play. In the bore 9 the advance control piston contacts a sealing piston 23 which via a sphere 24 acts on a thrust rod 25 which in turn via another sphere 26 abuts the housing 1. In a cavity 27 in the housing 1 a radially directed lever 28 is connected to the main control piston 4. The lever has a slot 29 on its outer end, in which a pin 30 is engaged in a tangentially play-free manner, which pin is mounted in an eccentric bore in a cylindrical adjusting piece 31 so as to form a cam. Eccentric piece 31 is mounted in rotationally rigid engagement with a shaft 32 in housing 1, and can be fixed by a block nut 33 which screws over an exterior thread on the shaft 32. The eccentricity of the bore with respect to the axis of rotation of the cylindrical adjusting piece 31 and the radial length of lever 28 and slot 29 are predetermined to provide that the resulting range of adjustment by member 31 corresponds to 2 to 5 steps of the stepping motor. A worm drive for rotating the adjusting piece 31 may be utilized by providing a bore (not shown) in the housing adjacent the adjustment piece and a worm drive (not shown) cooperatively engaging the adjusting piece on the side opposite the pin 30.

The advance control piston 11 is provided with a trapezoid thread 34 for interaction with the main control piston 4, the radially outer faces of which thread serve as inclined control edges. The annular space 3 is at one terminus of a channel 35 in the form of a transverse bore through the wall of control piston 4 which connects to bore 9, where it is immediately closed off by one of the threaded surfaces of the trapezoidal thread 34, whereby the surface 36 serves as a control edge which either closes off the channel 35 or provides an opening for said channel to the thread groove 37 which leads to the control space 12. The opposite surface 38, i.e., the surface 38 across groove 37 from surface 36, also serves as a control edge which either places the thread groove 37 in communication with a second channel 39 which opens out into the bore 9, or else closes off channel 39. Channel 39 leads to a lower pressure system, i.e. in practice to an outlet line T. In the embodiment of FIG. 1, the channel 39 comprises a transverse bore with an inner part 40 and an outer part 41, which parts are separated by a cylindrical socket piece 42 which is inserted in a longitudinal bore and which cuts off said transverse bore. Said socket piece comprises a dead end bore 43 which communicates with inner part 40 via a transverse bore 44. Outer part 41 is closed off by the outer surface of socket piece 42.

It is readily apparent to one skilled in the art that each rotational movement of the stepping motor 14 produces a rotational movement of the advance control piston 11, whereby the surfaces 36 and 38 alternately open and close the channels 35 and 39. Assuming that the area ratio of the surfaces 10 and 8 is about 2:1, two-edge control takes place wherein the main control piston follows, i.e., is controlled by, the inclined surfaces 36 and 38 until at least one null covering of a combination of, e.g., two of the openings A, B, P, and T is achieved. By prescribing the step, or angle, of the stepping motor 14, one may thus very precisely position the main control piston. Rough adjustment of the null position occurs with the spring centering of the advance control piston 11, i.e. with the positioning of the dog 18. Fine adjustment of the null position is accomplished by turning the eccentric piece 31, whereby the main control piston 4 can be moved rotationally in either direction until the advance control piston 11 and main control piston 4 are in proper adjustment with respect to each other. This adjustment is then fixed with locking nut 33.

I claim:

1. An electrohydraulic, two-stage proportional displacement valve comprising:

a valve housing;

a cylinder in said housing;

a main control piston mounted in said cylinder for axial displacement having two operating piston faces for selectively moving said piston axially in opposite directions, one of said piston faces having twice the area of the other;

an interior main bore in said main piston;

an advance control piston rotatably mounted in said main bore;

an inclined trapezoidal thread in the outer surface of said advance control piston forming a two-edge control element and communicating at one end of said thread with said one face of said main piston;

an outlet for said bore extending through one end of said main piston communicating said main bore with said cylinder;

a source of hydraulic pressure;

means to connect said source of hydraulic pressure to said other face of said main piston and to said main bore; and an electric stepping motor operatively connected to said advance control piston to rotate said advance control piston to selectively connect said trapezoidal thread to said source of hydraulic pressure fed to said main bore.

2. A valve as claimed in claim 1 wherein:

said cylinder and piston are stepped to form a differential cylinder and piston which form an annular cylinder and an annular face on said piston comprising said other face;

said means to connect said pressure source to said other face of said main piston comprises a first channel in said housing between said main bore and said annular cylinder controlled by said advance control piston; and further comprising a second channel between said main bore and a low pressure hydraulic system controlled by said advance control piston.

3. A valve as claimed in claim 2 wherein said low pressure system comprises an outlet channel.

4. A valve as claimed in claim 3 wherein:

said second channel comprises a longitudinal bore in said main piston parallel to said main bore, a tubular socket piece inserted in said longitudinal bore, a first transverse bore through the wall of said socket piece, and a second transverse bore through said main control piston communicating with said first transverse bore at one end and said main bore at the other end.

5. A valve as claimed in claim 1 and further comprising:

a coupling operatively connected to said stepping motor to be rotated thereby;

a seal means in the end of said housing adjacent said one face of said main piston;

a reduced diameter portion on said advance control piston extending from the end thereof adjacent said outlet of said main bore through said seal means in sealing relationship therewith and operatively connected at its outer end to said coupling to be rotated thereby;

a thrust bearing mounted in the end of said housing opposite to the end in which the seal means is mounted; and a thrust rod extending axially through said main bore having an inner end engaging the inner end of said advance control piston opposite to said reduced diameter portion and an outer end engaging said thrust bearing.

6. A valve as claimed in claim 5 wherein:

said thrust bearing is a spherical bearing; and further comprising a further spherical thrust bearing mounted in said main bore between the inner end of said advance control piston and the inner end of said thrust rod.

7. A valve as claimed in claim 5 and further comprising:

a sealing piston mounted in said main bore between the inner ends of said advance control piston and said thrust rod.

8. A valve as claimed in claim 7 and further comprising:

a further thrust bearing mounted in said sealing piston between said inner ends of said advance control piston and said thrust rod.

9. A valve as claimed in claim 1 wherein;

a said means to connect said source of hydraulic pressure to said other face of said main piston comprises a fluid flow conduit; and further comprising a pressure regulating valve operatively connected in said conduit having an inlet connected to said source of hydraulic pressure, an outlet connected to said other face of said main piston and a pressure reducing means between said inlet and outlet to reduce supply pressure from said source to a control pressure of constant magnitude.

10. A valve as claimed in claim 1 and further comprising:

spring means operatively mounted between said housing and said main piston to resiliently urge said main piston toward an axially centered position.

11. A valve as claimed in claim 10 and further comprising:

cooperating control openings in said housing at the wall of said cylinder and in the outer surface of said main piston;

further control openings in said main piston communicating with a portion of said main bore in which said advance control piston is disposed to selectively communicate with said trapezoidal thread; and spring means operatively connected to said advance control piston to resiliently urge said advance control piston into a centered position with respect to said housing, so that when said main piston and advance control piston are respectively centered all said control openings are respectively closed by said pistons, and when said pistons are displaced from their centered positions some of said control openings are selectively open.

12. A valve as claimed in claim 11 wherein said spring means for centering said advance control piston comprises:

a drive shaft on said stepping motor connected to said advance control piston;

a boss adjustably mounted on said drive shaft to rotate therewith;

a substantially radially extending lever on said boss;

a stop piece mounted on said housing;

first and second spiral springs operatively connected at their inner ends to said advance control piston and resiliently engaging against said stop piece at their outer ends, said spiral springs being oppositely orientated so that they resiliently urge said advance control piston in opposite rotational directions; and a substantially axially extending dog mounted on said lever radially spaced from said boss and extending between said outer ends of said spiral springs so that when said stepping motor is rotated said dog will lift the outer end of one of said spiral springs off of engagement with said stop piece, depending on the direction of rotation of said drive shaft.

13. A valve as claimed in claim 1 and further comprising:

control openings in said main piston communicating with said main bore so that the opening and closing thereof is controlled by the trapezoidal thread; and means operatively connected between said housing and said main piston for adjusting and fixing the rotational position of said main piston.

14. A valve as claimed in claim 13 wherein said means for adjusting and fixing the rotational position of said main piston comprises:

a chamber in said housing in which a part of said main piston is disposed;

a lever member attached to said main piston and disposed in said chamber;

a radially extending slot in said lever member;

an adjusting cylinder rotatably mounted in said housing;

a bore in said adjusting cylinder eccentric to the axis of rotation of said adjusting cylinder;

an adjusting pin mounted to one end in said eccentric bore and slidably engaging at the other end in said slot; and means to rotate said adjusting cylinder so that rotation thereof adjusts and fixes the rotational position of said main piston.

15. A valve as claimed in claim 14 wherein said adjusting cylinder is initially set in a position where said pin is spaced a maximum distance from said main piston.

16. A valve as claimed in claim 15 wherein the eccentricity of said eccentric bore and the length of said lever are such that the resulting range of adjustment corresponds to 2 to 5 steps of said stepping motor.

17. A valve as claimed in claim 14 wherein the eccentricity of said eccentric bore and the length of said lever are such that the resulting range of adjustment corresponds to 2 to 5 steps of said stepping motor.

* * * * *